US006233887B1

(12) United States Patent
Smith

(10) Patent No.: US 6,233,887 B1
(45) Date of Patent: May 22, 2001

(54) ROLLABLE SHINGLE-OVER ROOF RIDGE VENT AND METHODS OF MAKING

(75) Inventor: Joe E. Smith, Jacksonville, AR (US)

(73) Assignee: Lomanco, Inc., Jacksonville, AR (US)

( * ) Notice: Subject to any disclaimer, the term of this patent is extended or adjusted under 35 U.S.C. 154(b) by 0 days.

(21) Appl. No.: 09/263,267

(22) Filed: Mar. 5, 1999

(51) Int. Cl.[7] ..... E04H 12/28
(52) U.S. Cl. ..... 52/199; 52/198
(58) Field of Search ..... 52/198, 199

(56) References Cited

U.S. PATENT DOCUMENTS

| | | | |
|---|---|---|---|
| 1,028,725 | 6/1912 | Hodgson . | |
| 1,717,728 | 6/1929 | Moore . | |
| 2,049,863 | 8/1936 | Palmer | 189/1 |
| 2,214,183 | 9/1940 | Seymour | 108/8 |
| 2,388,759 | 11/1945 | Moore | 98/42 |
| 2,799,214 | 7/1957 | Roose | 98/42 |
| 2,868,104 | 1/1959 | Honholt et al. | 98/42 |
| 2,988,980 | 6/1961 | Tschudin | 98/40 |
| 3,185,070 | 5/1965 | Smith | 98/42 |
| 3,236,170 | 2/1966 | Meyer et al. | 98/42 |
| 3,241,474 | 3/1966 | Rousey et al. | 98/42 |
| 3,303,773 | 2/1967 | Smith et al. | 98/42 |
| 3,326,113 | 6/1967 | Smith et al. | 98/42 |
| 3,481,263 | 12/1969 | Belden | 98/42 |
| 3,625,134 | 12/1971 | Smith | 98/42 |
| 3,660,955 | 5/1972 | Simon | 52/420 |
| 3,949,657 | 4/1976 | Sells | 98/42 |
| 4,073,106 | 2/1978 | Malott | 52/199 |
| 4,090,435 | 5/1978 | Vallee | 98/42 |
| 4,252,590 | 2/1981 | Rasen et al. | 156/167 |

(List continued on next page.)

OTHER PUBLICATIONS

Branson Ultrasonics Corporation, *Plastics Joining Technology* (1994).

Branson Ultrasonics Corporation, *HH Series Horizontal Hot Plate Welders—Models HH24, HH42, HH72, and HH24S* (Jun. 1997).

Branson Ultrasonics Corporation, *Hot Plate Welder Model HV 12* (1993).

(List continued on next page.)

*Primary Examiner*—Carl D. Friedman
*Assistant Examiner*—Patrick J. Chavez
(74) *Attorney, Agent, or Firm*—Walker, McKenzie & Walker, P.C.

(57) ABSTRACT

A roof ridge vent for covering an opening at a peak of a roof. The roof ridge vent includes a top panel portion having first and second opposed lateral edges and having first and second opposed ends. The roof ridge vent includes a plurality of support members depending downwardly from the underside of the top panel portion, and the roof ridge vent also includes first and second lateral ventilation louvers respectively disposed adjacent the first and second opposed lateral edges. The vent also has first and second undulating sidewalls respectively downwardly depending from, and adjacent to, the first and second opposed lateral edges, with each of the sidewalls being non-planar and undulating along its said respective lateral edge such that the roof ridge vent may be flexingly rolled lengthwise into a spiral roll prior to installation and further may be unrolled lengthwise during installation over the peak of a roof. A method is also described for weldedly bonding sections of roof ridge vent by heating adjacent ends of successive sections above the melting point of the thermoplastic material, then abutting the heated ends, and then allowing the ends to cool below the melting point of the thermoplastic material. A variety of additional ways are shown for joining successive sections of roof ridge vent so as to create an elongated rollable length of roof ridge vent.

27 Claims, 9 Drawing Sheets

U.S. PATENT DOCUMENTS

| | | | | |
|---|---|---|---|---|
| 4,280,399 | | 7/1981 | Cunning | 98/42 |
| 4,325,290 | | 4/1982 | Wolfert | 98/42 |
| 4,342,807 | | 8/1982 | Rasen et al. | 428/180 |
| 4,554,862 | | 11/1985 | Wolfert | 98/42.21 |
| 4,643,080 | | 2/1987 | Trostle et al. | 98/42.21 |
| 4,676,147 | | 6/1987 | Mankowski | 98/42.21 |
| 4,782,743 | | 11/1988 | Quinnell | 98/42.21 |
| 4,817,506 | | 4/1989 | Cashman | 98/42.21 |
| 4,843,953 | | 7/1989 | Sells | 98/42.21 |
| 4,903,445 | | 2/1990 | Mankowski | 52/199 |
| 4,924,761 | | 5/1990 | MacLeod et al. | 98/42.21 |
| 4,957,037 | | 9/1990 | Tubbesing et al. | 98/42.21 |
| 5,009,149 | | 4/1991 | MacLeod et al. | 98/42.21 |
| 5,070,771 | | 12/1991 | Mankowski | 454/275 |
| 5,095,810 | * | 3/1992 | Robinson | 454/365 |
| 5,112,278 | | 5/1992 | Roberts | 98/365 |
| 5,122,095 | * | 6/1992 | Wolfert | 454/365 |
| 5,149,301 | | 9/1992 | Gates | 454/365 |
| 5,167,579 | | 12/1992 | Rotter | 454/365 |
| 5,288,269 | | 2/1994 | Hanson | 454/365 |
| 5,457,920 | * | 10/1995 | Waltz | 52/199 |
| 5,458,538 | | 10/1995 | MacLeod et al. | 454/365 |
| 5,561,953 | * | 10/1996 | Rotter | 52/198 |
| 5,673,521 | * | 10/1997 | Coulton et al. | 52/199 |
| 5,772,502 | * | 6/1998 | Smith | 454/365 |
| 5,797,222 | * | 8/1998 | Martin | 52/198 |
| 5,925,579 | * | 7/1999 | Neuner et al. | 442/175 |

OTHER PUBLICATIONS

Branson Ultrasonics Corporation, *Hot Plate Welder HH–15* (Apr. 1998).

Dukane Corporation, *HPV–60 Vertical Platen Hot Plate Welder* (1997).

Dukane Corporation, *HPV–48 Vertical Platen Hot Plate Welder* (1997).

Dukane Corporation, *PPV and HPV Hot Plate Welders* (1997).

Forward Technology Industries, Inc., *Hot Plate Welders* (Apr. 1998).

* cited by examiner

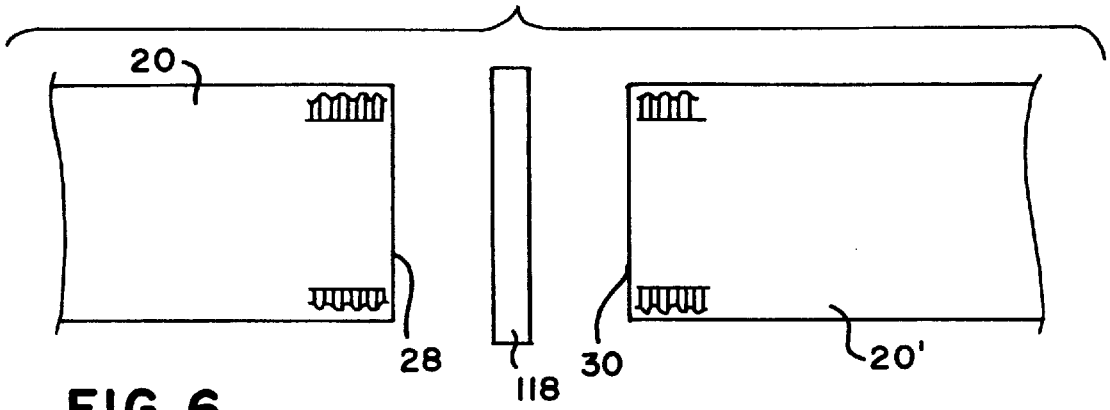
FIG. 6
FIG. 7
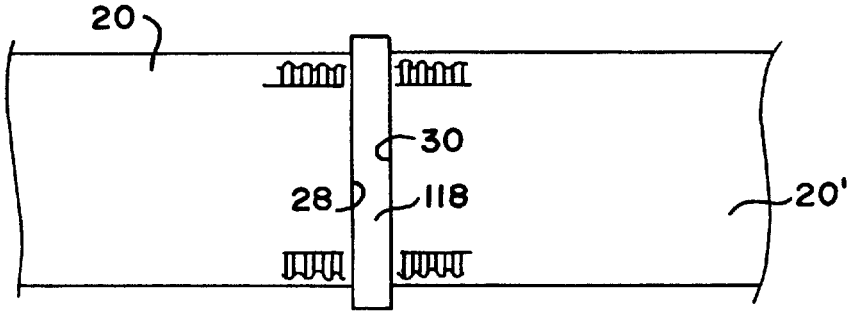
FIG. 8
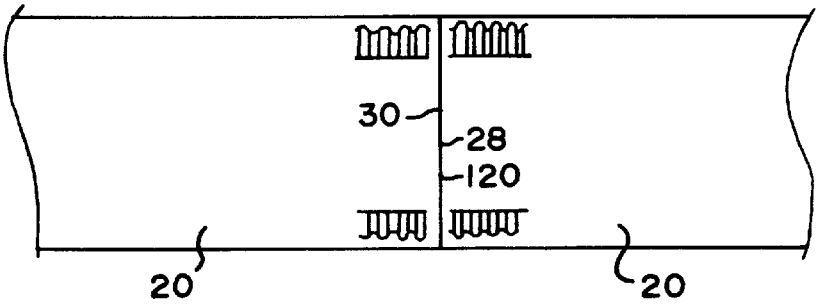

FIG. 9
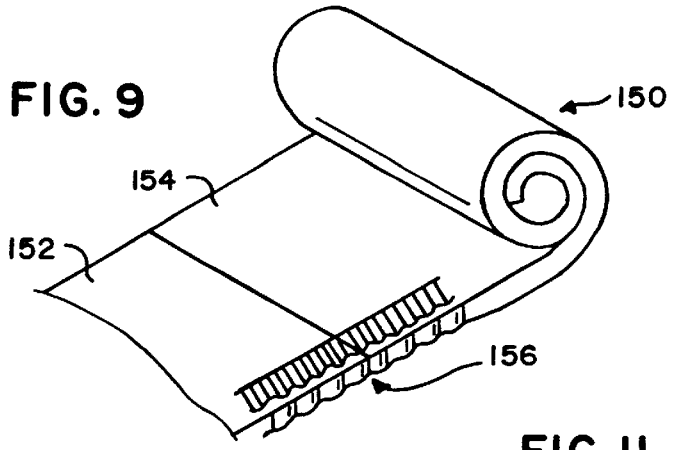
FIG. 10
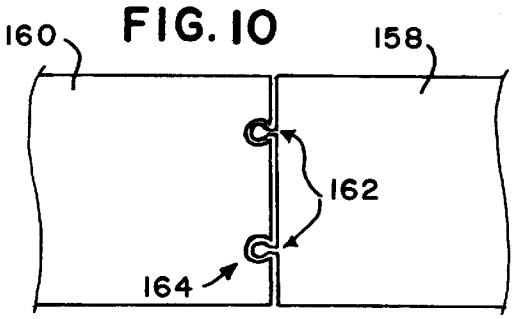
FIG. 11
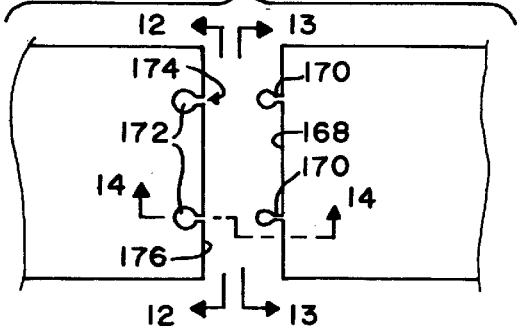
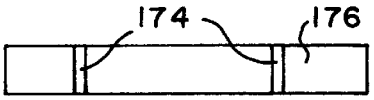
FIG. 12
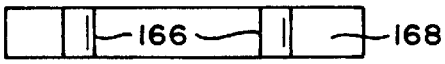
FIG. 13
FIG. 14
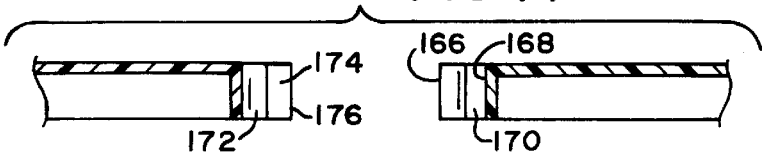
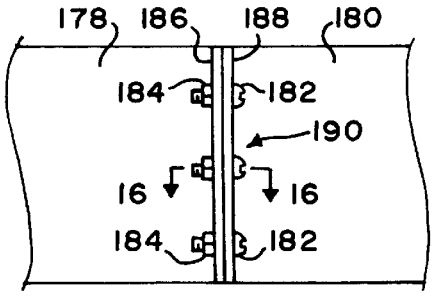
FIG. 15
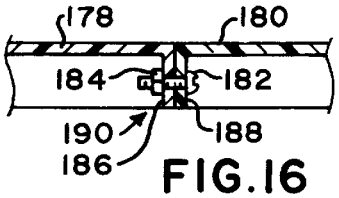
FIG. 16

FIG. 17
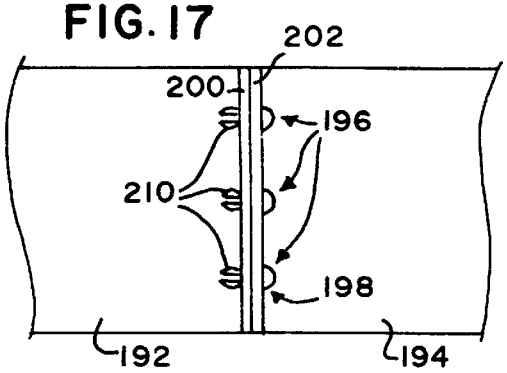
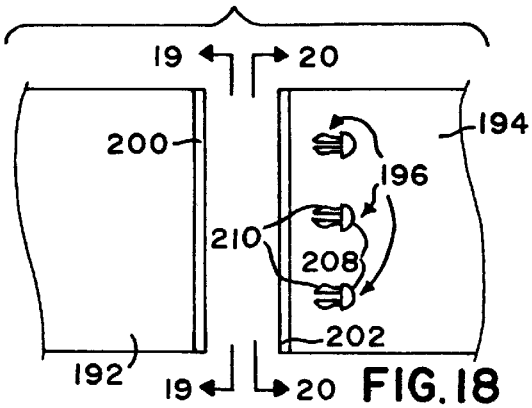
FIG. 18
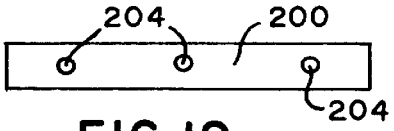
FIG. 19
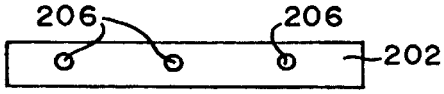
FIG. 20
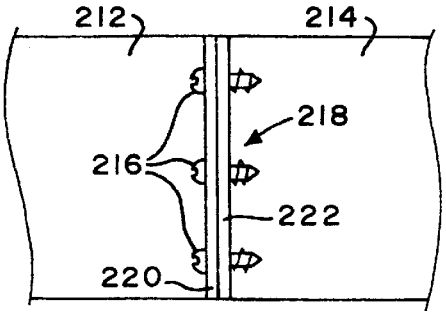
FIG. 21
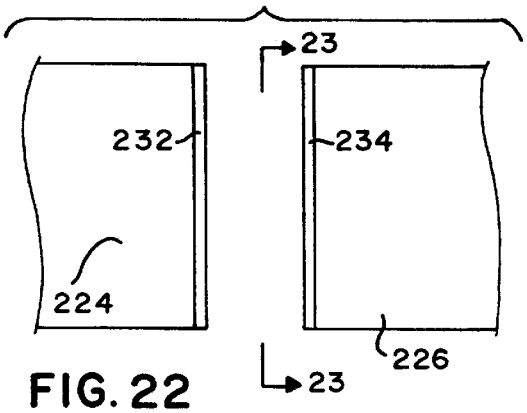
FIG. 22
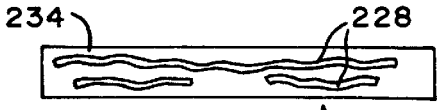
FIG. 23
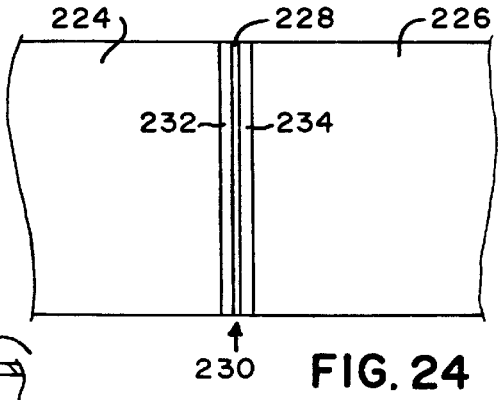
FIG. 24
FIG. 25
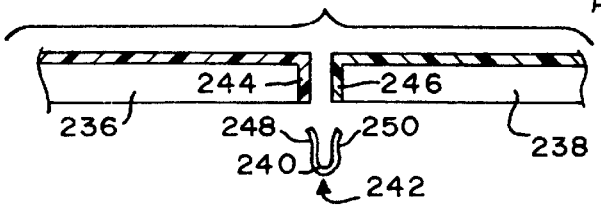

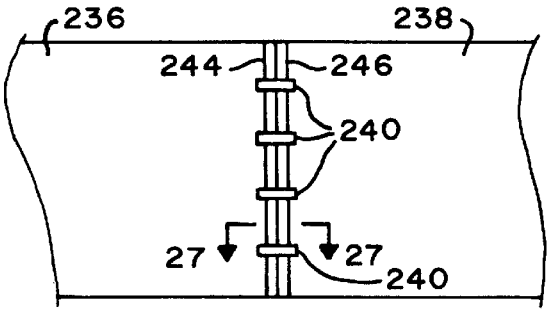
FIG. 26
FIG. 27
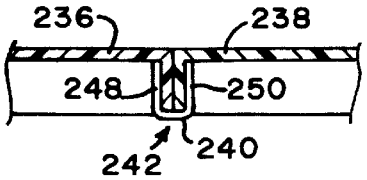
FIG. 30
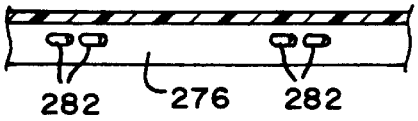
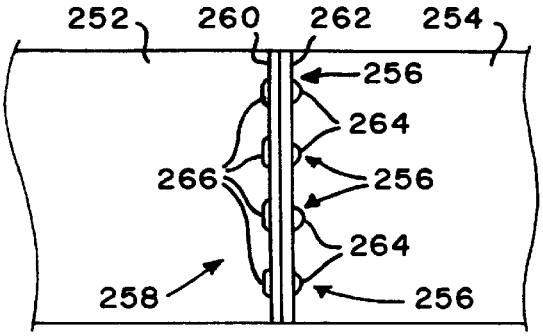
FIG. 28
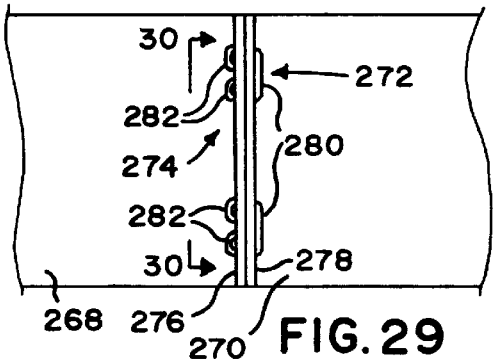
FIG. 29
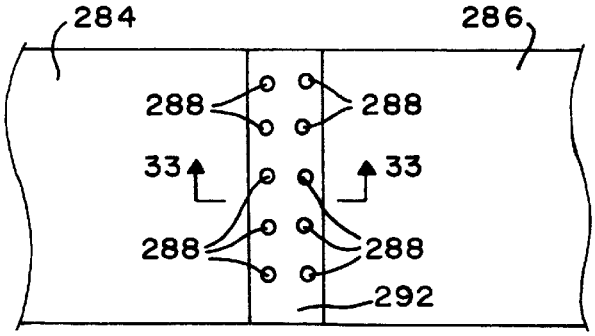
FIG. 31
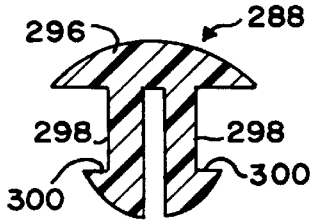
FIG. 32
(Prior Art)
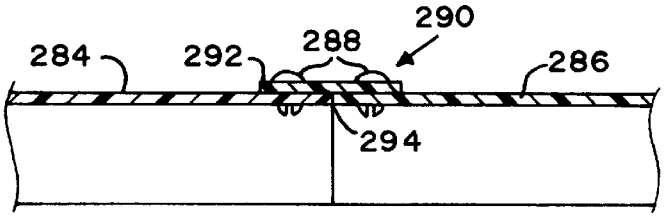
FIG. 33

ROLLABLE SHINGLE-OVER ROOF RIDGE VENT AND METHODS OF MAKING

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to roof ridge vents and, in particular, to adjustable pitch "shingle-over" roof ridge vents and methods of making same.

2. Information Disclosure Statement

It is often necessary or desirable in constructing buildings to provide for ventilation of attic space or other building space under sloped roofs. Well-known solutions include so-called "shingle-over roof ridge vents" such as that described in Robinson, U.S. Pat. No. 5,095,810, issued Mar. 17, 1992, and fully incorporated by reference herein, as well as that described in Wolfert, U.S. Pat. No. 5,122,095, issued Jun. 16, 1992, and fully incorporated by reference herein, as well as the shingle-over roof ridge vent described in Smith, U.S. Pat. No. 5,772,502, issued Jun. 30, 1998, and fully incorporated by reference herein. A plurality of such prior art shingle-over roof ridge vents are typically installed end-to-end longitudinally overlying the open ridge at the apex of a sloped roof, with well-known shingles, typically asphalt shingles, affixed over the top surface of the roof ridge vent. At the ends of the roof, the endmost shingle-over roof ridge vents typically have the gap between the roof ridge vent and the roof plugged with filter material as taught in the Wolfert patent or with foam material as taught in the Robinson patent, or as by an integral accordion-pleated end plug as described in the Smith patent, so as to prevent the entry of weather, wind, insects, birds, and the like. A disadvantage of such prior art roof ridge vents is that, because of their substantially rigid downwardly-depending planar lateral sidewalls, the prior art shingle-over roof ridge vents are rather rigid and cannot be compactly packaged in a continuous roll for transport to the installation site.

Prior art shingle-over roof ridge vents are known that can be rolled for compact packaging and transport to an installation site, but such prior art rollable shingle-over roof ridge vents have many disadvantages and design compromises as compared to non-rollable modern shingle-over roof ridge vents, and typically do a poor job of drawing hot air from within the underlying attic of the building, thereby causing heat buildup in the attic. Examples of such prior art shingle-over roof ridge vents are Morris, U.S. Pat. No. 5,651,734 (issued Jul. 29, 1997), and Coulton et al., U.S. Pat. No. 5,673,521 (issued Oct. 7, 1997).

Another problem faced by the prior art is that not all roofs are similarly sloped, and the differences in roof slope pitches necessitates that the shingle-over roof ridge vents be longitudinally flexible along the apex of the roof so as to conform to the slope of the particular roof. Such required flexibility heretofore precluded the use of end plugs integrally molded into the shingle-over roof ridge vents of the prior art. Prior art end plug solutions to this requirement of flexibility of the roof ridge vent include MacLeod et al., U.S. Pat. No. 5,009,149, issued Apr. 23, 1991, and fully incorporated herein by reference, as well as MacLeod et al., U.S. Pat. No. 5,548,538, issued Oct. 17, 1995, and fully incorporated herein by reference. These MacLeod patents teach the use of overlapping adjacent downwardly-depending tabs or wall members at the ends of the shingle-over roof ridge vents that slidably overlap one another as the roof ridge vent flexibly bends over the apex of the roof, so as to plug the exposed ends of the roof ridge vents. A problem with such a slidably overlapping construction for the end plugs is that a continuous seal is not formed at the ends of the roof ridge vents, thereby causing gaps or slots to exist in the end walls of the roof ridge vents through which insects, bugs, and the like may enter.

It is therefore desirable to have an adjustable pitch, shingle-over roof ridge vent whose ends are integral with the vent and sealed without the use of separate plugs or filter material, and without having gaps, slots, or holes through the ends of the vent, and in which the shingle-over roof ridge vent is rollable on a continuous roll for transport during storage and subsequent shipping to the installation site, where the roof ridge vent may be unrolled over the ridge during installation. It is further desirable that the rollable shingle-over roof ridge vent have means to create a "venturi-effect" draft to draw hot air outwardly from within the underlying attic.

It is still further desirable to provide methods of making rollable shingle-over roof ridge vents by joining sections of shingle-over roof ridge vents to form an elongated rollable roof ridge vent.

None of these references, either singly or in combination, disclose or suggest the present invention.

BRIEF SUMMARY OF THE INVENTION

The present invention is an improvement over the somewhat similar shingle-over roof ridge vent described in Smith, U.S. Pat. No. 5,772,502, issued Jun. 30, 1998, fully incorporated by reference herein, and a substantial improvement of the present invention is that the shingle-over roof ridge vent of the present invention is rollable along its longitudinal direction because of the novel undulating construction of its downwardly-depending non-planar lateral sidewalls.

It is an object of the present invention to provide an adjustable-pitch rollable shingle-over roof ridge vent having ventilation means adjacent each lateral sidewall, in which air-deflecting lips are provided to create a venturi effect to draw hot air from out of the building's attic and through the ventilation means. Additionally, it is an object of the present invention to provide accordion-pleated endwalls that allow the roof ridge vent to flexingly and bendingly adjust to the various pitches of roofs upon which the roof ridge vent is installed.

It is a further object of the present invention to provide a method of weldedly sealing adjacent portions of shingle-over roof ridge vents into a continuous length for subsequent rolling into a spiral roll. An additional object of the present invention is to provide a variety of methods of joining sections of shingle-over roof ridge vents into a continuous length for rolling into a spiral roll.

BRIEF DESCRIPTION OF THE SEVERAL VIEWS OF THE DRAWING

FIG. 6 is a schematic top view showing a first step in the method of meltingly joining successive sections of the present invention into a continuous roll.

FIG. 7 is a schematic top view showing a second step in the method of meltingly joining successive sections of the present invention into a continuous roll.

FIG. 8 is a schematic top view showing a third step in the method of meltingly joining successive sections of the present invention into a continuous length for subsequent rolling.

FIG. 9 is a perspective schematic view of sections of shingle-over roof ridge vents into a continuous length for rolling into a spiral roll.

FIG. 10 is a top plan view of a second method of joining successive sections of shingle-over roof ridge vents by interlocking fasteners so as to form a continuous length for subsequent rolling.

FIG. 11 is a top plan view of the second method of joining successive sections of shingle-over roof ridge vents, with the successive sections shown separated prior to joining.

FIG. 12 is an end view of one of the sections of shingle-over roof ridge vent shown in FIG. 11, taken substantially along the line 12—12 shown in FIG. 11.

FIG. 13 is an end view of the other of the sections of shingle-over roof ridge vent shown in FIG. 11, taken substantially along the line 13—13 shown in FIG. 11.

FIG. 14 is a partial longitudinal sectional view of the shingle over roof ridge vent sections shown in FIG. 11, taken substantially along the line 14—14 shown in FIG. 11.

FIG. 15 is a bottom view of a third method of joining successive sections of shingle-over roof ridge vents using screws and nuts securing successive endwalls together.

FIG. 16 is a partial longitudinal sectional view of the third method of joining successive sections of shingle-over roof ridge vents, taken substantially along the line 16—16 shown in FIG. 15.

FIG. 17 is a bottom view of a fourth method of joining successive sections of shingle-over roof ridge vents using split fasteners securing successive endwalls together.

FIG. 18 is a bottom view of the fourth method of joining successive sections of shingle-over roof ridge vents using split fasteners, with the successive sections shown separated prior to joining.

FIG. 19 is an end view of one of the sections of shingle-over roof ridge vent shown in FIG. 18, taken substantially along the line 19—19 shown in FIG. 18.

FIG. 20 is an end view of the other of the sections of shingle-over roof ridge vent shown in FIG. 18, taken substantially along the line 20—20 shown in FIG. 18.

FIG. 21 is a bottom view of a fifth method of joining successive sections of shingle-over roof ridge vents using self-tapping screws securing successive endwalls together.

FIG. 22 is a bottom view of a sixth method of joining successive sections of shingle-over roof ridge vents using glue or bonding compound securing successive endwalls together, with the sections shown separated prior to joining.

FIG. 23 is an end view of one of the sections of shingle-over roof ridge vent shown in FIG. 22, taken substantially along the line 23—23 shown in FIG. 22.

FIG. 24 is a bottom view of the sixth method of joining successive sections of shingle-over roof ridge vents using glue or bonding compound, with the sections shown glued together.

FIG. 25 is a partial longitudinal sectional view of a seventh method of joining successive sections of shingle-over roof ridge vents using clips securing successive endwalls together, with the sections shown separated prior to joining.

FIG. 26 is a bottom view of the seventh method of joining successive sections of shingle-over roof ridge vents using clips, with the sections shown joined together.

FIG. 27 is a partial longitudinal sectional view of the seventh method of joining successive sections of shingle-over roof ridge vents using clips, taken substantially along the line 27—27 shown in FIG. 26.

FIG. 28 is a bottom view of an eighth method of joining successive sections of shingle-over roof ridge vents using rivets securing successive endwalls together.

FIG. 29 is a bottom view of a ninth method of joining successive sections of shingle-over roof ridge vents using staples securing successive endwalls together.

FIG. 30 is a partial transverse sectional view of the ninth method of joining successive sections of shingle-over roof ridge vents using staples, taken substantially along the line 30—30 shown in FIG. 29.

FIG. 31 is a top view of a tenth method of joining successive sections of shingle-over roof ridge vents using push-in split fasteners through a joining strip.

FIG. 32 is a sectional detail of one of the prior art push-in split fasteners used in the tenth method of joining successive sections of shingle-over roof ridge vents.

FIG. 33 is a partial longitudinal sectional view of the tenth method of joining successive sections of shingle-over roof ridge vents using push-in split fasteners, taken substantially along the line 33—33 shown in FIG. 31.

DETAILED DESCRIPTION OF THE INVENTION

Figure 1:
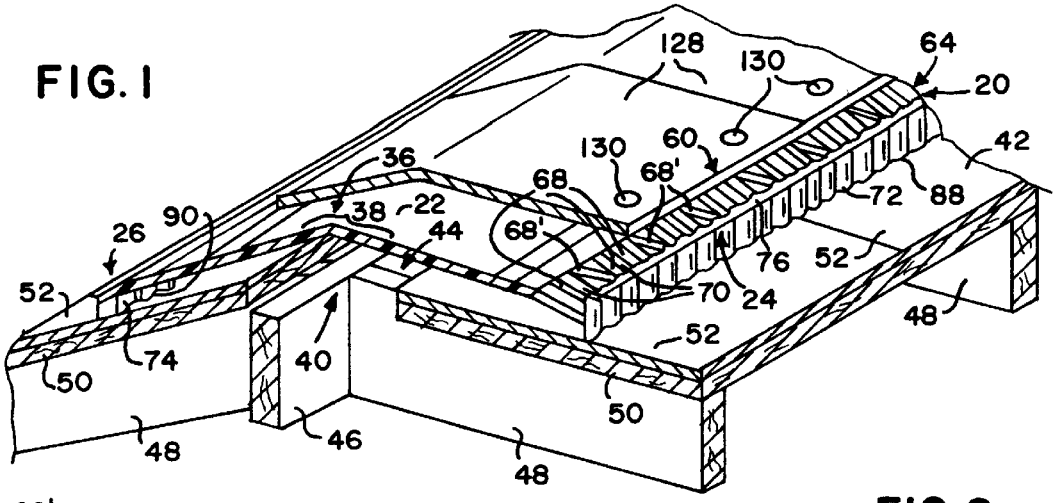
FIG. 1 is a perspective sectional view of the present invention installed at the apex of a roof, with portions of the invention and shingles thereover shown partially removed for clarity.

Referring to FIGS. 1–5, the shingle-over roof ridge vent 20 of the present invention, a so-called "shingle-over roof ridge vent" is seen to comprise a top panel portion 22 having first 24 and second 26 opposed lateral edges and having first 28 and second 30 opposed ends. The top panel portion 22 has an underside 32 and a topside 34 and further has a midsection 36 substantially parallel to the first and second lateral edges 24 and 26, with midsection 36 preferably being flexible along a centrally longitudinal region 38 substantially parallel to first and second lateral edges 24 and 26 so that roof ridge vent 20 may longitudinally flex along midsection 36 so as to rest across the peak or apex 40 of a roof 42 and thereby accommodate varying roof pitches. The roof ridge vent 20 is preferably constructed of a plurality of five foot (1.52 meters) long and 14.5 inches (36.8 cm.) wide injection-molded flexible and substantially identical plastic sections made of a thermoplastic material, such as a polypropylene copolymer with an elastomeric additive, preferably a so-called thermoplastic olefin ("TPO") material, with the sections being subsequently welded end-to-end in a manner hereinafter described so as to form a continuous and rollable length of roof ridge vent, typically 20 feet in length (6.1 meters) and 14.5 inches (36.8 cm.) wide per roll, with the typical thickness of top panel portion 22 being approximately 0.05 inches (1.27 mm.).

Roof ridge vent 20 is adapted for covering a well-known opening 44 at the peak or apex 40 of roof 42. In a manner well-known to those skilled in the art, roof 42 is formed with a longitudinal main beam 46 supported by a plurality of transverse cross beams such as cross beams 48, and cross beams 48 support well-known plywood decking panels 50 thereover, with decking panels 50 being covered by a plurality of shingles 52 and roofing paper (not shown) affixed to decking panels 50 as by nails or the like, in a manner well-known to those skilled in the art. Shingles 52 and decking panels 50 stop short of main beam 46 so as to form a gap or opening 44 adjacent main beam 46 and on either side thereof at the peak or apex of roof 42, in a manner well-known to those skilled in the art.

Figure 4:
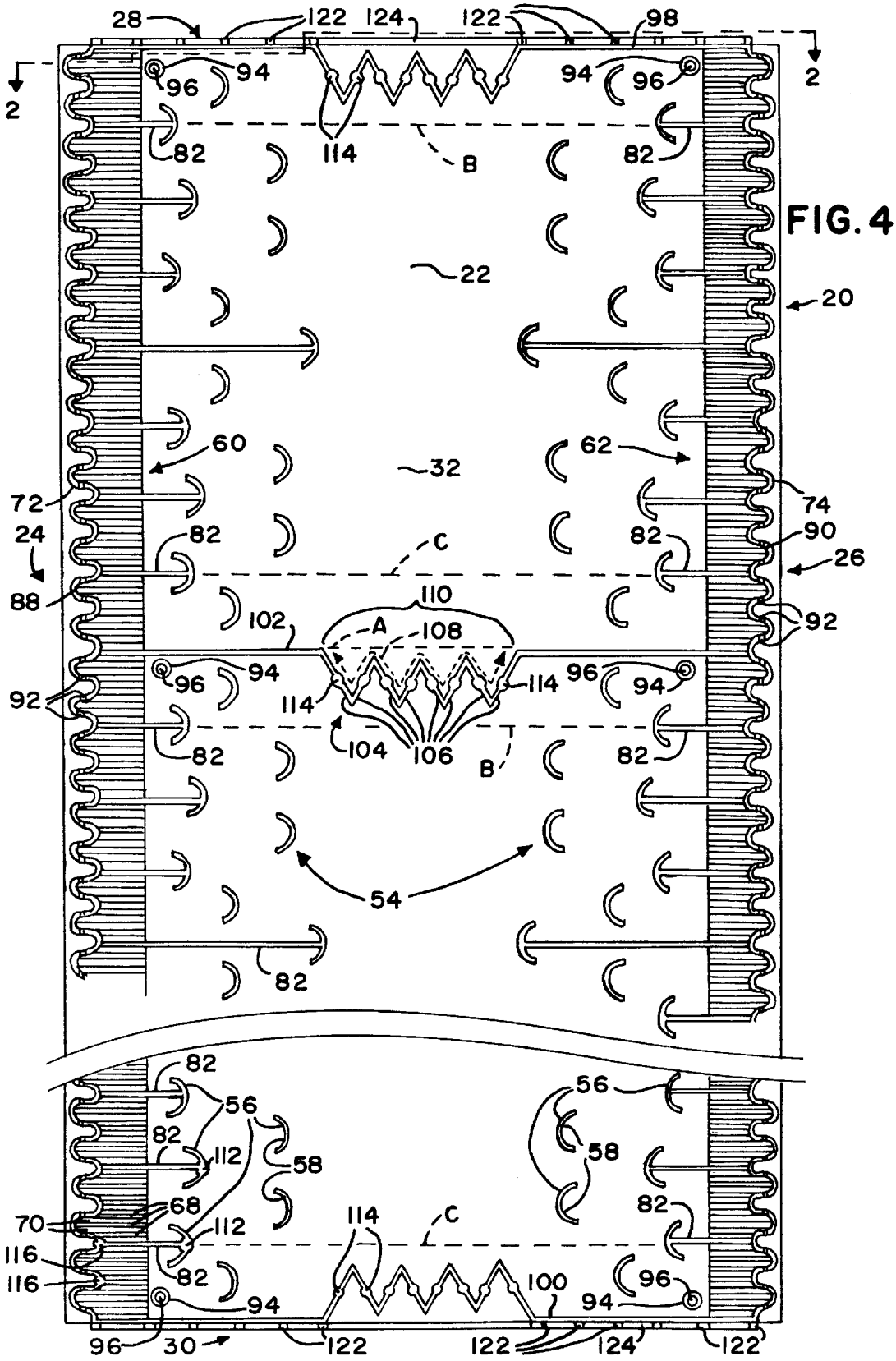
FIG. 4 is an underside plan view of the present invention in the unrolled condition, with hidden "cut lines" from the top side shown in dotted outline.

Roof ridge vent 20 also includes support means 54 for supporting top panel portion 22 above roof 42, with support means 54 preferably comprising a plurality of support members 56 depending downwardly from the underside 32 of top panel portion 22 as shown. Support members 56 are preferably staggered in a non-sinusoidal manner along the underside 32 of top panel portion 22, as best seen in FIG. 4, so as to allow air to flow between the support members 56, with support members 56 preferably being semicircular in horizontal cross-section and having the concave portion 58 opening toward the closest lateral edge (24 or 26, as appropriate) so as to impede the entry of snow or debris past support members 56 into opening 44. Additionally, the two sets of support members 56 together preferably span the respective lateral edges 24 and 26, with the sum of the lateral projections of the of support members 56 for each respective side covering the respective lateral edge 24 or 26 so as to impede the entry of snow or debris past support members 56 into opening 44 while allowing passage of air past the support members from opening 44 to lateral ventilation means adjacent each lateral edge as hereinafter described.

Figure 2:
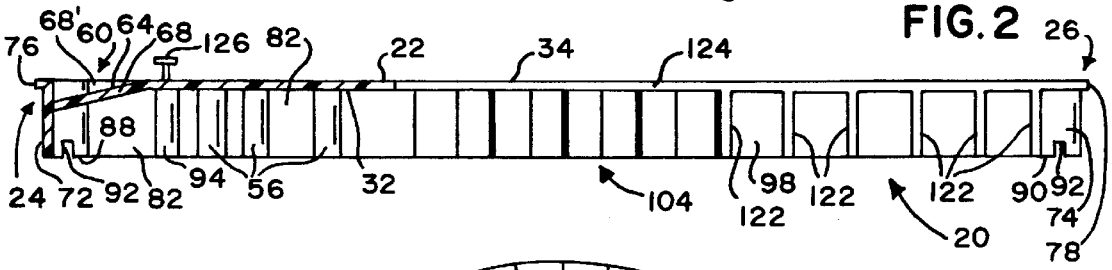
FIG. 2 is an end partial sectional view of the present invention taken substantially along the line 2—2 shown in FIG. 4.

Roof ridge vent 20 further includes first 60 and second 62 lateral ventilation means for allowing air to escape from within the building's attic, out the opening 44, and then to pass from under the roof ridge vent 20 and out, with first and second ventilation means 60 and 62 preferably being substantially mirror images of each other and being respectively disposed adjacent first and second lateral edges 24 and 26. Preferably, roof ridge vent 20 includes first 64 and second 66 downwardly-angled lateral portions respectively adjacent lateral edges 24 and 26, with first 64 and second 66 downwardly-angled lateral portions being substantial mirror images of each other and having a plurality of repeatingly spaced ribs 68 formed therewithin so as to define a series of spaced apertures or louvered slots 70 between spaced ribs 68, thereby providing lateral ventilation means 60 and 62 for roof ridge vent 20. As best seen in FIG. 2, the downward angle of lateral portions 64, 66 is preferably 15 degrees from the plane of top panel portion 22. The width of each rib 68 along the longitudinal direction of the roof ridge vent is typically and preferably between about 0.05 to 0.06 inches (1.27 to 1.52 mm.) and the width of each slot 70 between spaced ribs 68 is typically and preferably between about 0.1375 to 0.1275 inches (3.49 to 3.24 mm.).

Roof ridge vent 20 further includes first 72 and second 74 undulating sidewalls respectively downwardly depending from, and adjacent to, first and second opposed lateral edges 24 and 26. Because first and second undulating sidewalls 72 and 74 are substantially the same, a description of one will suffice for both.

Sidewall 72 is substantially non-planar as viewed from the bottom (see FIG. 4), undulating in a preferably sinusoidally-repeating wave-shaped manner as shown along lateral edge 24 and providing sidewall support for top panel portion 22. Above sidewall 72 and sealingly secured thereto is a first air-deflecting lip portion 76 that extends substantially horizontally outwardly from the top of sidewall 72, it being understood that there is a second and mirror-image substantially-identical lip 78 over second sidewall 74 such that a description of one suffices for both. As outside air rises and moves up the roof 42 toward the roof's peak, the air is deflected by the lips 76, 78 so as to create a region of low air pressure adjacent louvered openings 70 of ventilation means 60, 62 that draws air through louvered openings 70 by a "venturi effect", such that air is drawn from the building's attic, through opening 44, underneath the roof ridge vent 20 to ventilation means 60, 62, and then out louvered openings 70, thereby ventilating and cooling the building's attic. When air is blowing parallel to the roof's ridge at the top of the building (i.e., longitudinally along the roof ridge vent), upwardly-extending spaced baffles 68' (see FIGS. 1 and 2), whose structure is hereinafter described, similarly act to deflect the air and create a low air pressure region behind the baffles 68' that similarly draws air out of the building's attic through the louvered openings 70 of ventilation means 60, 62. It shall be understood that the inner edges 84, 86 of respective lip portions 76, 78 are substantially sinusoidal, not straight, as viewed from the top (see FIG. 5) because the inner edges 84, 86 of lip portions 76, 78 extend over and are sealingly secured to undulating sidewalls 72, 74, respectively and terminate on the inner side of undulating sidewalls 72, 74.

Figure 3:
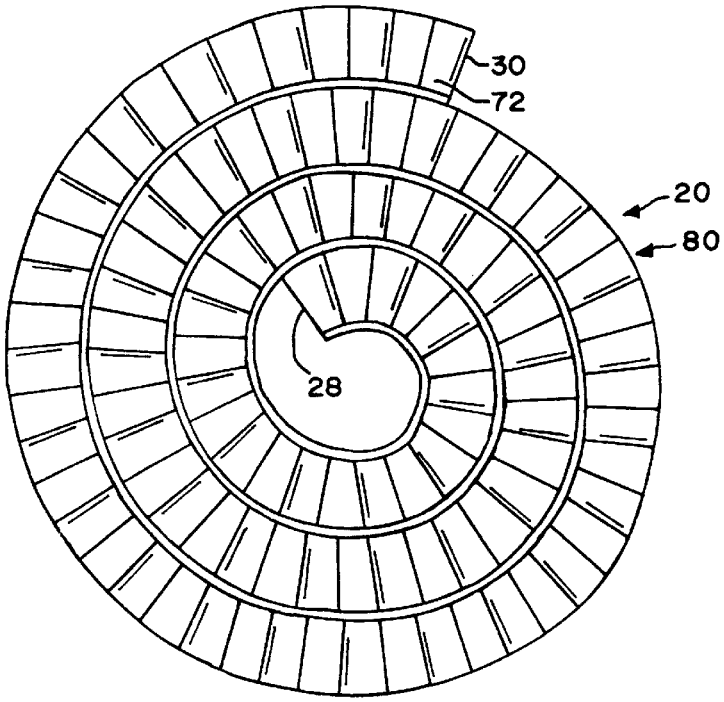
FIG. 3 is a side view of the present invention shown in the spirally-rolled condition.

Because of this wave-shaped sinusoidal undulation of non-planar sidewalls 72 and 74, the roof ridge vent 20 can be spirally rolled lengthwise so as to form a rolled condition 80 of the roof ridge vent 20 as shown in FIG. 3. Thus spirally rolled prior to installation, the elongated roof ridge vent 20 may be easily transported to the installation site, hoisted atop the roof, and then unrolled lengthwise along the apex of the roof for easy installation. It shall be understood that the non-planar sinusoidal undulation of the sidewalls 72 and 74 allows the sidewalls to flex as the roof ridge vent 20 is rolled and unrolled; in contrast, the planar sidewalls of prior art roof ridge vents prevent those prior art roof ridge vents from being spirally rolled.

Some of the downwardly-depending support members 56 preferably have downwardly-depending vertical transverse wall supports 82 extending from the center of the respective support member 56 laterally to the respective undulating sidewall 72, 74 so as to provide additional support for top panel portion 22 and to laterally guide the air flowing out ventilation means 60 and 62. Some of the ribs 68' of ribs 68 that form ventilation means 60 and 62, and preferably those ribs 68' acting as baffles and that are extensions of and are vertically above transverse wall supports 82, extend upwardly above first and second downwardly-depending angled and louvered portions 64, 66 (see especially FIGS. 1 and 2) so as to laterally and vertically guide the air flowing outwardly through ventilation means 60 and 62 from the attic of the building. Those ribs 68' that extend upwardly so as to act as baffles are slightly wider than the other ribs 68, being between approximately 0.050 and 0.100 inches (1.27 to 2.54 mm.) in width along the longitudinal dimension of roof ridge vent 20, with the slots 70 that are adjacent such ribs 68' being slightly smaller in width than the other slots 70, preferably being between about 0.100 and 0.125 inches (2.54 to 3.175 mm.) in width.

Sidewalls 72 and 74 each have a respective lower edge 88, 90 that rests upon the shingles 52 of the roof, and each lower edge 88, 90 has a plurality of drain apertures or slots 92 therein through its respective sidewall that allows water, which has fallen through the respective ventilation means 60 or 62 to drain from under the roof ridge vent 20 and flow down the roof.

Roof ridge vent 20 further has a plurality of free-standing cylindrical nail guides 94 downwardly depending from the underside 32 of top panel portion 22, with each nail guide 94 being substantially the same height as the downwardly-depending support members 56 and transverse wall supports 82 and with each nail guide 94 having a vertically-axial bore 96 therethrough for receiving an anchoring nail as hereinafter described. The free-standing nature of the cylindrical nail guides 94 contributes to the rollability of the roof ridge vent 20.

While other rollable shingle-over vents are known such as those described in Morris, U.S. Pat. No. 5,651,734 (issued Jul. 29, 1997), and in Coulton et al., U.S. Pat. No. 5,673,521 (issued Oct. 7, 1997), and while other shingle-over vents such as those described in Robinson, U.S. Pat. No. 5,095,810 (issued Mar. 17, 1992) and in Wolfert, U.S. Pat. No. 5,122,095 (issued Jun. 16, 1992) are known having outwardly-extending air-deflecting lips that create a venturi effect to draw air out from under the roof ridge vent, it is believed that the present invention is the first rollable shingle-over vent also having outwardly-extending air-deflecting lips 76, 78.

Roof ridge vent 20 further has a plurality of downwardly-depending transverse walls 98, 100, 102 spaced one from another and each sealingly joined to the underside 32 of top panel portion 22, there being a first transverse wall 98 at first end 28, a second transverse wall 100 at second end 30, and a plurality of intermediate transverse walls such as wall 102 (typically, four intermediate transverse walls 102) between first wall 98 and second wall 100, such that there is a transverse wall every foot (0.3 meters) along roof ridge vent 20. Each transverse wall 98, 100, and 102 is of substantially the same height, i.e., approximately one inch (2.54 cm.), as downwardly-depending support members 56, transverse wall supports 82, and nail guides 94, so as to provide further support for top panel portion 22 upon the roof. Because of the substantial similarity of the transverse walls 98, 100, and 102, a description of transverse wall 102 will suffice for all.

Transverse wall 102 has a pleated midportion 104 adjacent midsection 36 of top panel portion 22, and pleated midportion 104 includes a plurality of accordion pleats 106 sealingly joined in sequence to each other and to the midsection 36 of top panel portion 22. As midsection 36 flexes along the longitudinal region of flex 38, pleats 106 act as an accordion to flex and allow the roof ridge vent 20 to accommodate varying roof pitches while still maintaining a seal to top panel portion 22 and without having any gaps, slots, or holes through transverse wall 102.

The pleated midportion 104 has a total pleat length 108, defined as the sum of the pleat lengths of each of the pleats 106, and total pleat length 108 is preferably approximately 9.77 inches (24.8 cm.) total for the eight pleats shown. Additionally, the pleated midportion 104 has a midportion length 110, defined as the nominal transverse span of midportion 104 spanned by pleats 106, preferably having a span of approximately 4.4 inches (11.2 cm.) for midportion length 110 as shown, and the ratio of the total pleat length 108 divided by the midportion length 110 is preferably at least 1.5 so as to provide sufficient flexibility in the pleated midportion to accommodate flexing of roof ridge vent 20 over roof apexes of varying pitch. Although eight pleats are shown in each pleated midportion 104 in the preferred embodiment, it will be understood that the number of pleats may be greater or lesser, as desired, providing that the required flexibility of the accordion-pleated midportion is maintained. The accordion-pleated midportions and associated transverse walls will serve as end plugs for a length of roof ridge vent in a manner hereinafter described.

Although not necessarily a part of the roof ridge vent 20, roof ridge vent 20 may have a plurality of enlarged cylindrical ejector pin seats or posts 112, 114, and 116 against which well-known cylindrical ejector pins forcibly rest to eject the roof ridge vent 20 from the injection mold within which roof ridge vent 20 is formed. Some of the ejector pin seats or posts 112 are centered on the curved support members 56, and others of the ejector pin seats or posts 114 are placed along the pleats of the transverse walls 98, 100, 102, and still others of the ejector pin seats or posts 116 are spaced along the undulating sidewalls 72 and 74. It should be understood that, while only some of the ejector pin seats or posts 112, 114, and 116 are shown, others are typically placed as needed on many other support members 56 and at numerous places along undulating sidewalls 72 and 74, and at various locations along the underside of lips 76, 78, to eject the roof ridge vent 20 from the injection mold in a manner well-known to those skilled in the art.

Figure 5:
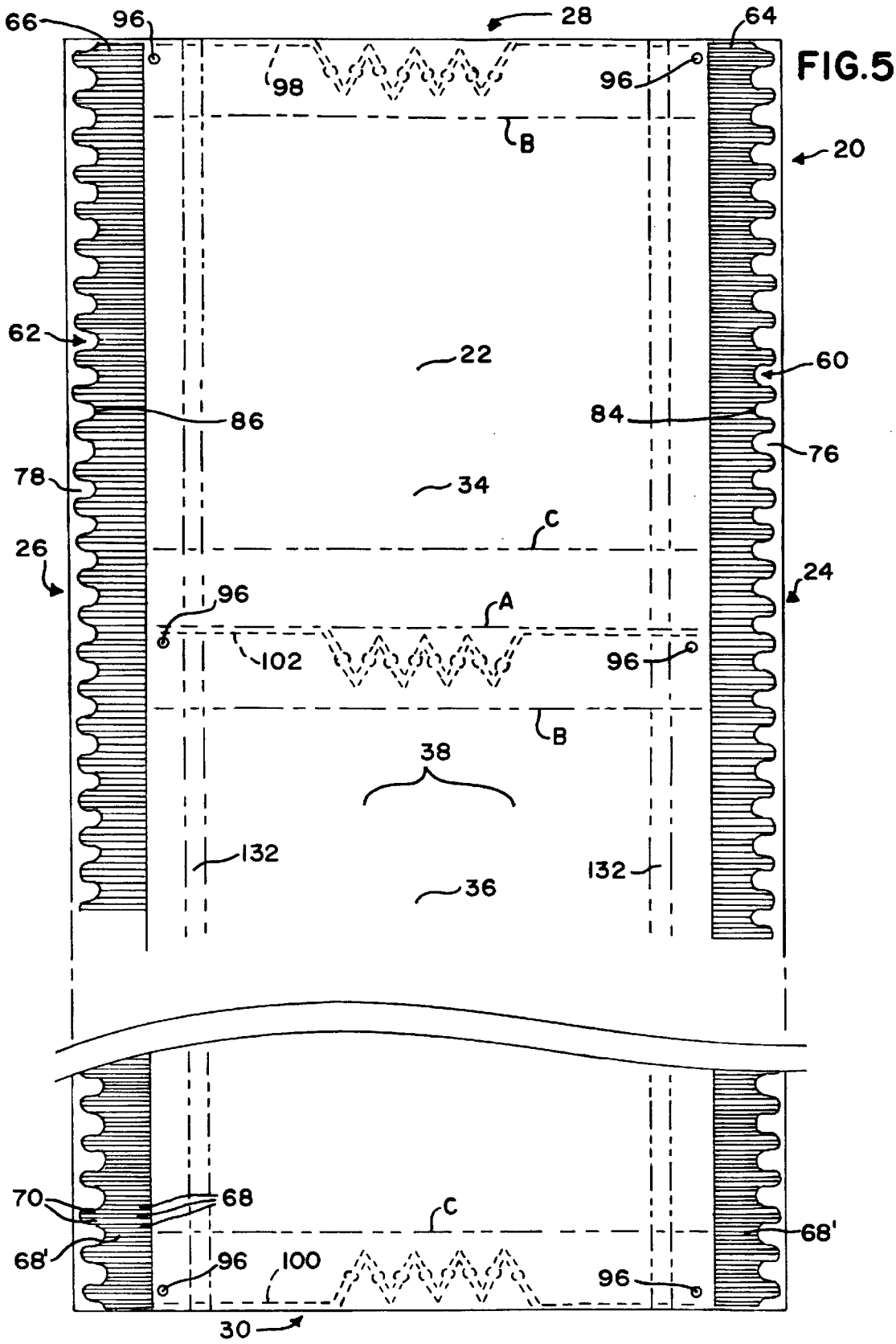
FIG. 5 is a top plan view of the present invention shown in the unrolled condition, with transverse baffles from the underside shown in dotted outline.

As will now be described, roof ridge vent sections, each substantially identical to roof ridge vent section 20 shown in FIGS. 4 and 5, are welded together end-to-end to form a continuous roll of roof ridge vent, typically twenty feet (6.1 meters) long, with four sections, each five feet (1.52 meters) in length, being welded together end-to-end in a manner that will now be described.

As shown in FIGS. 6–8, an electrically-heated plate 118 is placed between substantially-identical first and second roof ridge vent sections 20 and 20', with the first opposed end 28 of first roof ridge vent section 20 facing the second opposed end 30 of second roof ridge vent section 20'. The two opposed ends 28, 30 are brought together with heated plate 118 therebetween, and the two opposed ends 28, 30 are heated above the melting point of the thermoplastic material from which first and second roof ridge vent sections 20 and 20' are formed. The heated plate 118 is then removed and opposed ends 28 and 30 are abuttingly clamped together and held while the heated ends are allowed to cool below the melting point of the thermoplastic material, thereby forming a welded bond 120 between the abutting opposed ends. It should be understood that this manner of assembly creates back-to-back accordion pleats at the joint because of the abutting of transverse wall 98 of end 28 of roof ridge vent section 20 with transverse wall 100 of end 30 of roof ridge vent section 20'.

To accommodate and facilitate this welding, a plurality of substantially similar spaced vertical protrusions 122 are formed into each opposed end 28 and 30 of each roof ridge vent section (see FIGS. 2 and 4), with these protrusions 122 being approximately 0.080 inches (0.20 cm.) in outwardly-projecting thickness by approximately 0.125 inches (0.32 cm.) wide, extending for the height of respective transverse walls 98, 100. A similar protrusion extension 124 of top panel portion 22 projects horizontally outwardly a similar distance of 0.080 inches (0.20 cm.), and the majority of the welding bond takes place along these protrusions 122 and 124, which matingly bond when heated to similar aligned protrusions on the abutting end of another roof ridge vent section.

While the use of a thermally-heated plate is preferred to practice the method of joining the abutting roof ridge vent sections, ultrasonic welding can also be used in which ultrasonic vibrations are used to heat the abutting opposed ends of the roof ridge vent sections.

Suitable hot plate welding equipment for use in practicing the method of the present invention for joining successive roof ridge vent sections would be a modified version of the well-known Model HV-12 hot plate welder manufactured by Branson Ultrasonics Corporation, 41 Eagle Road, Danbury, Conn. 06813-1961, or a modified version of the well-known Model PPV-12 hot plate welder manufactured by Dukane Corporation, 2900 Dukane Drive, St. Charles, Ill. 60174, or preferably a modified version of the well-known Model VA-1015 hot plate welder manufactured by Forward Technology Industries, Inc., 13500 County Road 6, Minneapolis, Minn. 55441. The modification of all of these well-known hot plate welders would be to modify the dimensions of the heated hot plate within the welder to have dimensions of preferably approximately 2 inches (5 cm.) in height and 18 inches (45.7 cm) in width so as to accommodate the thermal welding of the roof ridge vent sections of the present invention in a manner hereinbefore described. Of course, the dimensions of the heated hot plate would appropriately scale if larger or smaller roof ridge vent sections were joined.

Referring to FIGS. 1–5, to use the roof ridge vent 20 of the present invention, a roof 42 is first constructed in a manner well-known to those skilled in the art, with a main beam 46 being supported by cross-beams 48 and with decking panels 50 being covered by roofing paper (not shown) and shingles 52, with shingles 52 typically being made of asphalt and being nailed to decking panels 50 using well-known roofing nails (not shown). If the building's roof has already previously been fully shingled, then the cap shingles are removed from the entire length of the roof's ridge so as to expose the ridge. If the roof is being newly-constructed, then cap shingles are not installed at this point.

The top of the decking panels are then cut at the apex of the roof to create opening 44, leaving approximately six inches (15.2 cm.) of roof decking at either end of the building uncut so that the opening 44 stops six inches (15.2 cm.) from either end of the building. If the building's roof is constructed with "ridge pole construction" as shown in FIG. 1 with a main beam 46 running the length of the roof's ridge, then the transverse width of opening 44 should be 3.125 inches (7.94 cm.); if, instead, the building's roof is constructed with "truss construction" (not shown) in which the main beam 46 is absent and opposing cross beams 48 abut at the ridge of the roof, then the width of the opening 44 should be 1.5 inches (3.81 cm.). Preferably, a chalk line should be used, in a manner well-known to those skilled in the art, to mark the cut for opening 44, and a well-known circular saw should then be used to cut opening 44, taking care to set the depth of the saw to avoid cutting cross beam rafters 48. The cut decking over the ridge should then be removed, exposing opening 44.

Next, a chalk line should be snapped longitudinally parallel to the peak of the roof and, for the size roof ridge vent 20 shown in FIGS. 1–5, about 7 inches (17.78 cm.) down from the peak and on each side of the roof. This chalk line will be used to keep the roof ridge vent 20 aligned correctly and evenly centered over the roof's peak during installation. The roof ridge vent 20 is then unrolled starting with end 30 being placed in alignment with one end of the roof and then unrolling the roll, transversely centered along the ridge of the roof using the previously-placed chalk lines, the length of the roof, thereby causing the roof ridge vent to have an accordion-pleated midportion of transverse wall 100 at one end of the roof ridge vent. The roof ridge vent 20 should be nailed down to the roof, beginning at one unrolled end 30 of the vent, using a plurality of well-known ring shank or spiral nails 126 (see FIG. 2), each preferably 2.5 inches (6.35 cm.) long, respectively inserted into the bores 96 of nail guides 94, and then nails 126 are pounded into decking panels 50 using a hammer or the like, so as to secure roof ridge vent 20 to roof 42.

To prematurely terminate a roll of roof ridge vent 20 if the full roll is not needed, a plurality of lines A, B, and C are moldedly provided on the top side 34 of top panel portion 22 as shown in FIG. 5 for guiding the cutting of the roll. Although not visible from the top of roof ridge vent 20, the placement of transverse walls 98, 100, and 102 are shown in hidden outline in FIG. 5 to show the placement of the transverse walls relative to cut lines A, B, and C. Likewise, lines A, B, and C are shown in hidden outline in FIG. 4 to show their placement relative to transverse walls 98, 100, and 102, although hidden lines A, B, and C are not visible when the roof ridge vent is viewed from the underside as shown in FIG. 4.

When the roll of roof ridge vent 20 is to be cut, it should be transversely cut along a cut guide line A (i.e., between a guide line B and C) so as to leave an accordion pleated section exposed at the end of the roof ridge vent portion on the roof, thereby serving as an endplug to the exposed end of the roof ridge vent. Before using the remaining and as-yet unrolled portion of the roof ridge vent, the remaining portion should be transversely cut at the next guide line B along the roll, which will leave somewhat less than one foot (0.3 meter) of discarded scrap between this cut line B and the previously-cut guide line A while also leaving an accordion pleated midsection at the beginning of the roll for beginning another installation. It should be noted that guide lines B and C are adjacent and to one side of respective transverse wall supports 82 so that, when a cut is made along guide line B, a transverse wall support 82 will be adjacent the end of the roof ridge vent portion on the roof so as to provide support for the exposed cut end. If one roll (or partial roll) of roof ridge vent 20 is not sufficient for covering the length of the roof's peak, then a second roll of roof ridge vent 20 may be used, with the accordion-pleated midsection at the beginning of the second roll abutting the accordion-pleated midsection at the end of the first roll and then being nailingly secured to the deck boards as heretofore described. The installed sections of roof ridge vents 20 will thus have exposed accordion-pleated end plugs at either end of the roof, thereby sealing the ends of the roof ridge vents from entry of insects, debris, snow, etc. under the roof ridge vents and into the opening 44 at the apex of the roof.

Finally, a plurality of cap shingles 128 are placed atop the secured roof ridge vent sections and roofing nails 130 are inserted through cap shingles 128 along the nail guide lines 132 that are molded into the topside 34 of top panel portion 22, thereby securing the cap shingles 128 to the roof ridge vent portions for diversion of water thereover and into the louvered slots 70 and then out through drain slots 92 in a manner hereinbefore described.

FIGS. 10–47 show a number of additional methods of joining successive sections of shingle-over roof ridge vent into a continuous length for subsequent rolling into a spiral roll 150 as shown in FIG. 9. It should be understood that these additional methods, together with the method of welding successive sections of shingle-over roof ridge vent as heretofore described, can all produce a continuous length of spirally-rolled shingle-over roof ridge vent 150 as shown in FIG. 9. Heretofore, lengths of prior art spirally-rolled and non-rollable shingle-over roof ridge vent were simply abuttingly placed end-to-end on a roof, causing gaps and leakage of rainwater therethrough at the abutting joint. The joining of successive sections of shingle-over roof ridge vent, in the manner of the various methods of the present invention, so as to produce a continuous length of spirally-rolled shingle-over roof ridge vent, solves these problems with the prior art and allows a required length of shingle-over roof ridge vent to be cut from a larger roll upon installation.

It should also be understood that these methods of joining successive sections of shingle-over roof ridge vent are not limited to the undulating sidewall construction of the present invention as heretofore described, but can also be used with other prior art rollable shingle-over roof ridge vent sections such as Coulton et al., U.S. Pat. No. 5,673,521 (issued Oct. 7, 1997) and Morris, U.S. Pat. No. 5,651,734 (issued Jul. 29, 1997), and both of these patents are hereby fully incorporated herein by reference. It shall be understood that many details of the shingle-over ridge vent sections shown in FIGS. 10–47, e.g., sidewalls and louvered ventilation means, are omitted for clarity in order to focus this portion of the description on the various methods of joining successive sections of shingle-over roof ridge vent.

All of these ways of joining successive sections of shingle-over roof ridge vent require that the roof ridge vent 150 be sufficiently flexible in its lengthwise direction so that the roof ridge vent may be flexingly rolled in the lengthwise direction into a spiral roll (see FIG. 9 or FIG. 3) prior to installation and further may be unrolled in the lengthwise direction during and after installation over the opening at the peak of the roof (see FIG. 9 or FIG. 1) with the lengthwise direction being parallel to the peak of the roof, and with the roof ridge vent 150 comprising a first roof ridge vent section 152, a second roof ridge vent section 154, and joining means 156, hereinafter described (or as in the welded method of joining heretofore described) securing the first roof ridge vent section 152 to the second roof ridge vent section 154.

FIGS. 10–29 show second through ninth methods of joining successive sections of shingle-over roof ridge vents so as to form a continuous length for subsequent rolling. The common feature of the second through ninth methods of joining is that the successive sections of shingle-over roof ridge vents used with these methods have abutting endwalls. The abutting endwalls may have an accordion-pleated midportion (not shown) as heretofore described so as to allow the endwalls of the shingle-over roof ridge vent to flex over the apex of the roof, or else the endwalls of the shingle-over roof ridge vent may include adjacent overlapping portions separated from one another by vertical slots (not shown) through the endwalls, such as shown in MacLeod et al., U.S. Pat. No. 5,009,149 (issued Apr. 23, 1991) or as shown in Wolfert, U.S. Pat. No. 5,122,095 (issued Jun. 16, 1992), with both of these patents hereby being fully incorporated herein by reference, so as to allow the shingle-over roof ridge vent to flex over the apex of the roof, or else the endwalls may have an open gap (not shown) in the midportion of the endwalls, again so as to allow the shingle-over roof ridge vent to flex over the apex of the roof. These specific details of allowing the transverse endwalls to flex over the apex of a roof are well-known to those skilled in the art, and will not be repeated here.

FIGS. 10–14 show a second method of joining successive first and second sections 158, 160 of shingle-over roof ridge vents using mating interlocking fasteners 162 at the abutting endwalls as the joining means 164 so as to form a continuous length of roof ridge vent for subsequent rolling. Interlocking fasteners 162 preferably comprise a vertical cylindrical portion 166 that is attached to and extending from first endwall 168 upon a support member 170 that is, in turn, substantially thinner than the diameter of first vertical cylindrical portion 166. Each vertical cylindrical portion 166 is slidably received into a mating vertical bore 172 within second section 160, with bore 172 being open through slot 174 to second endwall 176 so as to allow the vertical sliding receipt of support member 170 therethrough, thereby entrappingly interlocking cylindrical portion 166 within bore 172 with first and second endwalls 168, 176 abutting one another.

FIGS. 15–16 show a third method of joining successive sections 178, 180 of shingle-over roof ridge vents using bolts or screws 182 and mating nuts 184 through the abutting first and second endwalls 186, 188 so as to form a continuous length of roof ridge vent for subsequent rolling. Joining means 190 comprises screws 182 inserted through holes drilled through first and second endwalls 186, 188, with nuts 184 being screwingly received onto screws 182 so as to entrappingly bind abutting first and second endwalls 186, 188 together.

FIGS. 17–20 show a fourth method of joining successive sections 192, 194 of shingle-over roof ridge vents using well-known split fasteners 196 as joining means 198 through the abutting endwalls 200, 202 so as to form a continuous length of roof ridge vent for subsequent rolling. As with the screws of the third method heretofore described, split fasteners 196 are inserted through mating holes 204, 206 in endwalls 200, 202, with the endwalls 200, 202 being entrapped between the head 208 and expanded split fingers 210 of fasteners 196. It shall be understood that the split fasteners may also be of the form shown in FIG. 32.

FIG. 21 shows a fifth method of joining successive sections 212, 214 of shingle-over roof ridge vents using self-tapping screws 216 as the joining means 218 threadedly received through the abutting endwalls 220, 222 so as to form a continuous length of roof ridge vent for subsequent rolling.

FIGS. 22–24 show a sixth method of joining successive sections 224, 226 of shingle-over roof ridge vents using bonding compound or glue 228 as the joining means 230 to bond the abutting endwalls 232, 234 together so as to form a continuous length of roof ridge vent for subsequent rolling. The glue 228 is first spread on the outer surface of one endwall 234 and the endwalls 232, 234 are then clamped or held together as shown in FIG. 23 with glue 228 being sandwiched therebetween and allowed to set and harden so as to adhesively bond the endwalls 232, 234 together.

FIGS. 25–27 show a seventh method of joining successive sections 236, 238 of shingle-over roof ridge vents using clips 240 as joining means 242 to secure the abutting endwalls 244, 246 together so as to form a continuous length of roof ridge vent for subsequent rolling. Generally U-shaped clips 240 are well-known to those skilled in the art, and have spaced opposed fingers 248, 250 that entrap abutting sidewalls 244, 246 when abutting sidewalls 244, 246 are slidably and entrappingly received between the opposed fingers 248, 250 of clips 240 as shown in FIG. 27.

FIG. 28 shows an eighth method of joining successive sections 252, 254 of shingle-over roof ridge vents using well-known rivets 256 as joining means 258 through the abutting endwalls 260, 262 so as to form a continuous length of roof ridge vent for subsequent rolling. The operation of rivets 256 is similar to that of the screws and nuts shown in FIGS. 15–16, with the endwalls 260 and 262 being entrapped between the head 264 and deformed end 266 of rivets 256.

FIGS. 29–30 show a ninth method of joining successive sections 268, 270 of shingle-over roof ridge vents using staples 272 as joining means 274 through the abutting endwalls 276, 278 so as to form a continuous length of roof ridge vent for subsequent rolling. Endwalls 276, 278 are entrapped between the head 280 and clenched fingers 282 of staples 272.

FIGS. 31–47 show tenth through fourteenth methods of joining successive sections of shingle-over roof ridge vents so as to form a continuous length of roof ridge vent for subsequent rolling. The common feature of the tenth through fourteenth methods of joining is that the successive sections of shingle-over roof ridge vents used with these methods are not required to have abutting endwalls. Examples of rollable shingle-over roof ridge vents without abutting endwalls are shown in Coulton et al., U.S. Pat. No. 5,673,521 (issued Oct. 7, 1997) and Morris, U.S. Pat. No. 5,651,734 (issued Jul. 29, 1997), but, heretofore, successive sections of such prior art shingle-over roof ridge vents were simply placed adjacent to one another on the roof without joining prior to covering the roof ridge vents with shingles.

FIGS. 31–33 show a tenth method of joining successive sections 284, 286 of shingle-over roof ridge vents using well-known push-in split fasteners 288 as joining means 290 through a joining strip 292 so as to form a continuous length of roof ridge vent for subsequent rolling. Joining strip 292 overlaps joint 294 where first and second roof vent sections 284, 286 abut, with joining strip 292 being entrapped with sections 284 or 286 between the head 296 and expanded split fingers 298 of fasteners 288, with outwardly-facing lips 300 on fingers 298 of fasteners 288 engaging the underside of sections 284, 286 so as to secure fasteners 288 to sections 284, 286.

Figure 34:
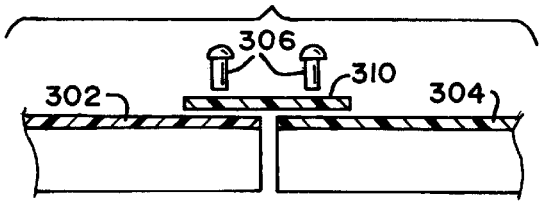
FIG. 34 is a partial longitudinal sectional view of an eleventh method of joining successive sections of shingle-over roof ridge vents using rivets through a joining strip, with the sections shown separated prior to joining.
Figure 35:
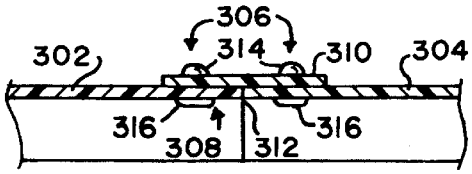
FIG. 35 is a partial longitudinal sectional view of the eleventh method of joining successive sections of shingle-over roof ridge vents using rivets, with the sections shown joined together.

FIGS. 34–35 show a eleventh method of joining successive sections 302, 304 of shingle-over roof ridge vents using rivets 306 as joining means 308 through a joining strip 310 so as to form a continuous length of roof ridge vent for subsequent rolling. Joining strip 310 overlaps joint 312 where first and second roof vent sections 302, 304 abut, with joining strip 310 being entrapped with sections 302 or 304 between the head 314 and deformed end 316 of rivets 306. It shall be understood that the top view of this eleventh method of joining looks substantially similar to FIG. 31.

Figure 36:
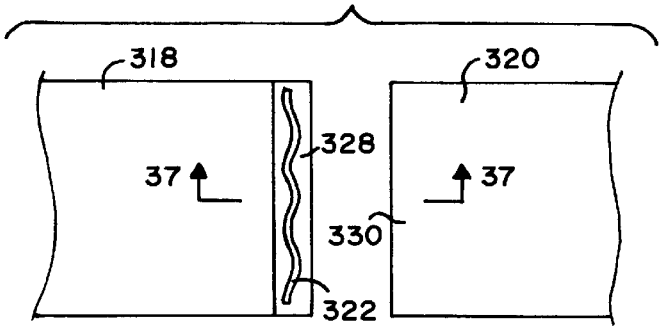
FIG. 36 is a top view of a twelfth method of joining successive sections of shingle-over roof ridge vents using glue or bonding compound to seal a lapped joint, with the sections shown separated prior to joining.
Figure 37:
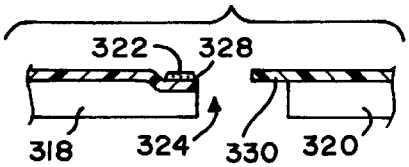
FIG. 37 is a partial longitudinal sectional view of the twelfth method of joining successive sections of shingle-over roof ridge vents using glue or bonding compound, taken substantially along the line 37—37 shown in FIG. 36.
Figure 38:
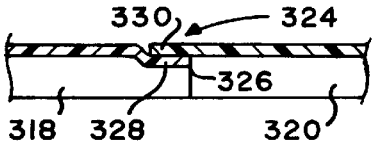
FIG. 38 is a partial longitudinal sectional view of the twelfth method of joining successive sections of shingle-over roof ridge vents using glue or bonding compound, with the sections shown joined together.

FIGS. 36–38 show a twelfth method of joining successive sections 318, 320 of shingle-over roof ridge vents using bonding compound or glue 322 as a joining means 324 to bond an overlapping joint so as to form a continuous length of roof ridge vent for subsequent rolling. First and second sections 318, 320 are seen to abut at a joint 326. Joining means 324 is seen to comprise a first portion 328 of first roof ridge vent section 318 overlapping a second portion 330 of second roof ridge vent section 320, and is seen to further to comprise glue 322 bonding first portion 328 to second portion 330. Glue 322 is applied to one or both of overlapping portions 328, 330, and the two portions are then overlappingly mated as shown in FIG. 38 and glue 322 is allowed to harden and thereby adhesively bond sections 318, 320 together.

Figure 39:
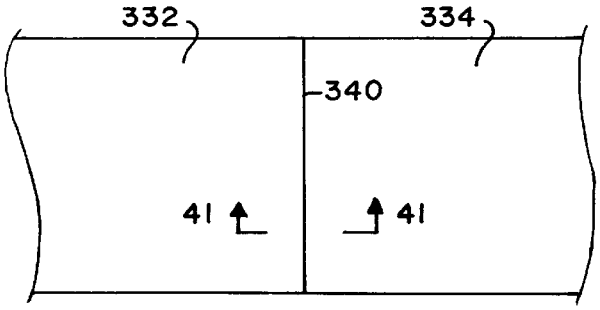
FIG. 39 is a top view of a thirteenth method of joining successive sections of shingle-over roof ridge vents using a joining strip secured by glue or bonding compound, with the sections shown abutted prior to joining and prior to gluing the joining strip thereto.
Figure 40:
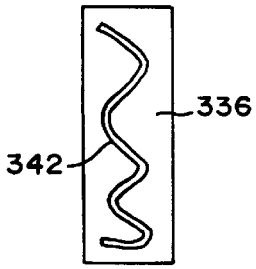
FIG. 40 is a view of the joining strip of the thirteenth method prior to joining the successive sections of shingle-over roof ridge vents, showing the application of glue or bonding compound to one side of the joining strip.
Figure 41:
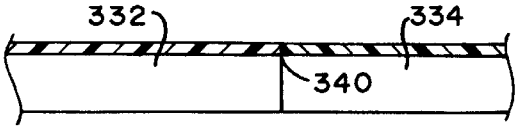
FIG. 41 is a partial longitudinal view of the thirteenth method of joining successive sections of shingle-over roof ridge vents using a joining strip secured by glue or bonding compound, with the sections shown abutted prior to joining and prior to gluing the joining strip thereto, taken substantially along the line 41—41 shown in FIG. 39.
Figure 42:
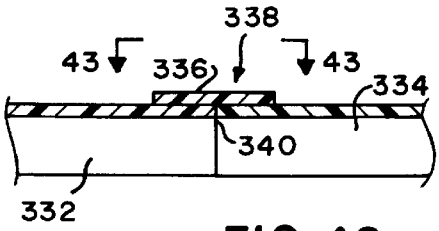
FIG. 42 is a partial longitudinal view of the thirteenth method of joining successive sections of shingle-over roof ridge vents using a joining strip secured by glue or bonding compound, after gluing the joining strip to the successive sections.
Figure 43:
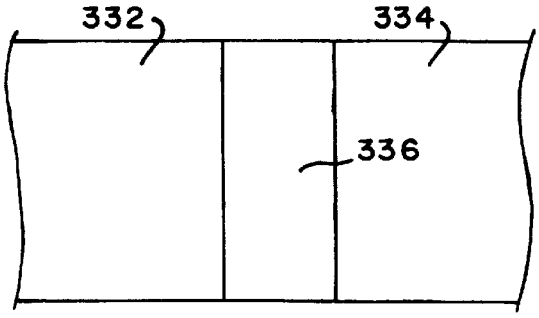
FIG. 43 is a top view of the thirteenth method of joining successive sections of shingle-over roof ridge vents using a joining strip secured by glue or bonding compound, after gluing the joining strip to the successive sections, taken substantially along the line 43—43 shown in FIG. 42.
Figure 44:
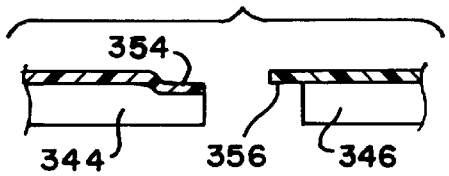
FIG. 44 is a partial longitudinal sectional view of a fourteenth method of joining successive sections of shingle-over roof ridge vents using staples to secure an overlapped joint, with the sections shown separated prior to joining.
Figure 45:
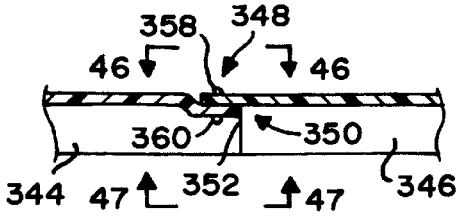
FIG. 45 is a partial longitudinal sectional view of the fourteenth method of joining successive sections of shingle-over roof ridge vents using staples, with the sections shown joined together.
Figure 46:
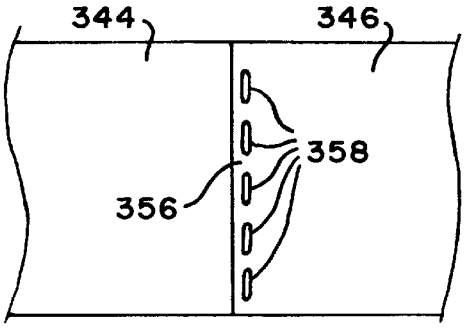
FIG. 46 is a top view of the fourteenth method of joining successive sections of shingle-over roof ridge vents using staples, with the sections shown joined together, taken substantially along the line 46—46 shown in FIG. 45.
Figure 47:
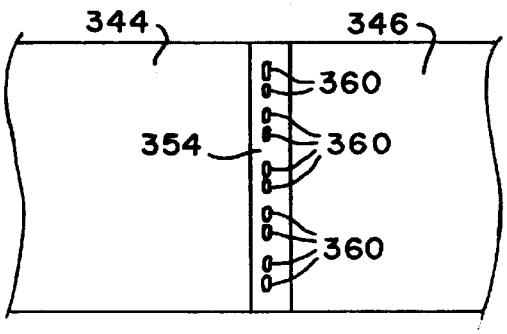
FIG. 47 is a bottom view of the fourteenth method of joining successive sections of shingle-over roof ridge vents using staples, with the sections shown joined together, taken substantially along the line 47—47 shown in FIG. 45.

FIGS. 39–43 show a thirteenth method of joining successive sections 332, 334 of shingle-over roof ridge vents using a joining strip 336 bonded or glued atop the adjoining sections 332, 334 as a joining means 338 so as to form a continuous length of roof ridge vent for subsequent rolling. Joining strip 336 overlaps joint 340 where first and second roof vent sections 332, 334 abut, with joining strip 336 being adhesively bonded to first and second sections 332, 334 by a glue 342 therebetween. As shown in FIGS. 39 and 41, first and second sections 332, 334 are abutted at joint 340, and then glue 342 is applied to the interface between joining strip 336 and first and section sections 332, 334, preferably by applying glue 342 to the underside of joining strip 336, and joining strip 336 is then overlappingly placed astride joint 340 and glue 342 is allowed to harden and thereby adhesively bond sections 332 and 334 to joining strip 336.

FIGS. 44–47 show a fourteenth method of joining successive sections 344, 346 of shingle-over roof ridge vents using staples 348 as a joining means 350 to secure an overlapping joint so as to form a continuous length of roof ridge vent for subsequent rolling. First and second sections 344, 346 are seen to abut at a joint 352. Joining means 350 is seen to comprise a first portion 354 of first roof ridge vent section 344 overlapping a second portion 356 of second roof ridge vent section 346, and is seen to further to comprise staples 348 securing first portion 354 to second portion 356 by entrapping first and second portions 354, 356 between the head 358 and clenched fingers 360 of staples 348.

Although the present invention has been described and illustrated with respect to a preferred embodiment and a preferred use therefor, it is not to be so limited since modifications and changes can be made therein which are within the full intended scope of the invention.

I claim:

1. A roof ridge vent for covering an opening at a peak of a roof, said roof ridge vent comprising:

(a) a top panel portion having first and second opposed lateral edges and having first and second opposed ends; said top panel portion having an underside and further having a midsection substantially parallel to said first and second opposed lateral edges;

(b) support means for supporting said top panel portion above the roof, said support means comprising a plurality of support members depending downwardly from said underside of said top panel portion;

(c) first and second lateral ventilation means respectively disposed adjacent said first and second opposed lateral edges; and (d) first and second undulating sidewalls respectively downwardly depending from, and adjacent to, said first and second opposed lateral edges, each of said first and second sidewalls being non-planar and undulating along its said respective lateral edge such that said roof ridge vent may be flexingly rolled lengthwise into a spiral roll prior to installation and further may be unrolled lengthwise during installation over the peak of a roof, said undulating of said first sidewall being in and out relative to said second sidewall and said undulating of said second sidewall being in and out relative to said first sidewall.

2. The roof ridge vent as recited in claim 1, in which each of said first and second sidewalls undulates along its respective lateral edge in a non-planar repeating and substantially sinusoidal wave-shaped manner.

3. The roof ridge vent as recited in claim 2, in which each of said first and second sidewalls has a lower edge, with each said lower edge having a plurality of drain slots therein through its respective sidewall.

4. The roof ridge vent as recited in claim 1, in which each of said first and second sidewalls has a lower edge, with each said lower edge having a plurality of drain slots therein through its respective sidewall.

5. The roof ridge vent as recited in claim 1, in which said roof ridge vent further includes a plurality of downwardly-depending transverse walls spaced one from another and sealingly joined to said top panel portion, each said transverse wall having a pleated midportion adjacent to said midsection of said top panel portion; each said pleated midportion of each said transverse wall comprising a plurality of adjacent pleats sealingly joined in sequence to each other and to said midsection of said top panel portion.

6. The roof ridge vent as recited in claim 5, in which said plurality of adjacent pleats of said pleated midportion of each said transverse wall has a total pleat length and said pleated midportion of said transverse wall has a midportion length, and said total pleat length divided by said midportion length is a ratio of at least 1.5.

7. The roof ridge vent as recited in claim 1, in which said roof ridge vent further includes first and second air-deflecting lips respectively extending along said first and second lateral edges and respectively adjacent said first and second sidewalls and extending outwardly therefrom.

8. The roof ridge vent as recited in claim 7, in which said first and second air-deflecting lips are respectively over said first and second sidewalls and respectively sealingly secured thereto.

9. The roof ridge vent as recited in claim 1, in which said top panel portion includes first and second downwardly-angled lateral portions interposed between said midsection and said first and second lateral edges, respectively, and said first and second lateral ventilation means each have a plurality of slots formed respectively through said first and second lateral portions of said top panel portion.

10. A roof ridge vent for covering an opening at a peak of a roof, said roof ridge vent comprising:

(a) a top panel portion having first and second opposed lateral edges and having first and second opposed ends; said top panel portion having an underside and further having a midsection substantially parallel to said first and second opposed lateral edges; said top panel portion further including first and second downwardly-angled lateral portions interposed between said midsection and said first and second lateral edges, respectively;

(b) support means for supporting said top panel portion above the roof, said support means comprising a plurality of support members depending downwardly from said underside of said top panel portion;

(c) first and second lateral ventilation means respectively disposed adjacent said first and second opposed lateral edges; each of said first and second lateral ventilation means having a plurality of slots formed respectively through said first and second lateral portions of said top panel portion;

(d) first and second undulating sidewalls respectively downwardly depending from, and adjacent to, said first and second opposed lateral edges, each of said first and second sidewalls being non-planar and undulating, in a non-planar repeating and substantially sinusoidal wave-shaped manner, along its said respective lateral edge such that said roof ridge vent may be flexingly rolled lengthwise into a spiral roll prior to installation and further may be unrolled lengthwise during installation over the peak of a roof, said undulating of said first sidewall being in and out relative to said second sidewall and said undulating of said second sidewall being in and out relative to said first sidewall; and (e) first and second air-deflecting lips respectively extending along said first and second lateral edges and respectively adjacent said first and second sidewalls and extending outwardly therefrom.

11. The roof ridge vent as recited in claim 10, in which said roof ridge vent further includes a plurality of downwardly-depending transverse walls spaced one from another and sealingly joined to said top panel portion, each said transverse wall having a pleated midportion adjacent to said midsection of said top panel portion; each said pleated midportion of each said transverse wall comprising a plurality of adjacent pleats sealingly joined in sequence to each other and to said midsection of said top panel portion.

12. The roof ridge vent as recited in claim 11, in which said plurality of adjacent pleats of said pleated midportion of each said transverse wall has a total pleat length and said pleated midportion of said transverse wall has a midportion length, and said total pleat length divided by said midportion length is a ratio of at least 1.5.

13. The roof ridge vent as recited in claim 10, in which each of said first and second sidewalls has a lower edge, with each said lower edge having a plurality of drain slots therein through its respective sidewall.

14. A shingle-over roof ridge vent for covering an opening at a peak of a roof, said roof ridge vent being sufficiently flexible in a lengthwise direction such that said roof ridge vent may be flexingly rolled in said lengthwise direction into a spiral roll prior to installation and further may be unrolled in said lengthwise direction during and after installation over the opening at the peak of the roof with said lengthwise direction being parallel to the peak of the roof, said roof ridge vent comprising:

(a) a first roof ridge vent section;

(b) a second roof ridge vent section; and (c) joining means securing said first roof ridge vent section abuttingly end-to-end lengthwise to said second roof ridge vent section;

each of said first and second roof ridge vent sections having first and second downwardly depending undulating sidewalls that undulate in and out relative to each other.

15. The roof ridge vent as recited in claim 14, in which said first roof ridge vent section has a first endwall and said second roof ridge vent section has a second endwall abutting said first endwall, and said joining means comprises mating interlocking fasteners on said first and second endwalls.

16. The roof ridge vent as recited in claim 14, in which said first roof ridge vent section has a first endwall and said second roof ridge vent section has a second endwall abutting said first endwall, and said joining means comprises a screw and nut binding said first and second endwalls together.

17. The roof ridge vent as recited in claim 14, in which said first roof ridge vent section has a first endwall and said second roof ridge vent section has a second endwall abutting said first endwall, and said joining means comprises a split fastener through said first and second endwalls.

18. The roof ridge vent as recited in claim 14, in which said first roof ridge vent section has a first endwall and said second roof ridge vent section has a second endwall abutting said first endwall, and said joining means comprises a screw threadedly received through said first and second endwalls.

19. The roof ridge vent as recited in claim 14, in which said first roof ridge vent section has a first endwall and said second roof ridge vent section has a second endwall abutting said first endwall, and said joining means comprises a glue bonding said first endwall to said second endwall.

20. The roof ridge vent as recited in claim 14, in which said first roof ridge vent section has a first endwall and said second roof ridge vent section has a second endwall abutting said first endwall, and said joining means comprises a clip having spaced opposed fingers entrapping said first and second endwalls therebetween.

21. The roof ridge vent as recited in claim 14, in which said first roof ridge vent section has a first endwall and said second roof ridge vent section has a second endwall abutting said first endwall, and said joining means comprises a rivet securing said first endwall to said second endwall.

22. The roof ridge vent as recited in claim 14, in which said first roof ridge vent section has a first endwall and said second roof ridge vent section has a second endwall abutting said first endwall, and said joining means comprises a staple securing said first endwall to said second endwall.

23. The roof ridge vent as recited in claim 14, in which said first roof ridge vent section and said second roof ridge vent section abut at a joint, and said joining means comprises:

(a) a joining strip overlapping said joint;

(b) a first split fastener securing said joining strip to said first roof ridge vent section; and (c) a second split fastener securing said joining strip to said second roof ridge vent section.

24. The roof ridge vent as recited in claim 14, in which said first roof ridge vent section and said second roof ridge vent section abut at a joint, and said joining means comprises:

(a) a joining strip overlapping said joint;

(b) a first rivet securing said joining strip to said first roof ridge vent section; and (c) a second rivet securing said joining strip to said second roof ridge vent section.

25. The roof ridge vent as recited in claim 14, in which said first roof ridge vent section and said second roof ridge vent section abut at a joint, and said joining means comprises:

(a) a first portion of said first roof ridge vent section overlapping a second portion of said second roof ridge vent section; and (b) a glue bonding said first portion of said first roof ridge vent section to said second portion of said second roof ridge vent section.

26. The roof ridge vent as recited in claim 14, in which said first roof ridge vent section and said second roof ridge vent section abut at a joint, and said joining means comprises:

(a) a joining strip overlapping said joint; and (b) a glue bonding said joining strip to said first and second roof ridge vent sections.

27. The roof ridge vent as recited in claim 14, in which said first roof ridge vent section and said second roof ridge vent section abut at a joint, and said joining means comprises:

(a) a first portion of said first roof ridge vent section overlapping a second portion of said second roof ridge vent section; and (b) a staple securing said first portion of said first roof ridge vent section to said second portion of said second roof ridge vent section.

* * * * *